US012270209B2

(12) United States Patent
Hannig et al.

(10) Patent No.: US 12,270,209 B2
(45) Date of Patent: Apr. 8, 2025

(54) PANEL HAVING FRACTURE-RESISTANT COUPLING ELEMENTS

(71) Applicant: AKZENTA PANEELE + PROFILE GMBH, Kaisersesch (DE)

(72) Inventors: Hans-Jürgen Hannig, Bergisch Gladbach (DE); Egon Hoff, Mastershausen (DE)

(73) Assignee: Akzenta Paneele + Profile GMBH, Kaisersesch (DE)

( * ) Notice: Subject to any disclaimer, the term of this patent is extended or adjusted under 35 U.S.C. 154(b) by 150 days.

(21) Appl. No.: 17/917,286

(22) PCT Filed: Apr. 7, 2021

(86) PCT No.: PCT/EP2021/059108
§ 371 (c)(1),
(2) Date: Oct. 6, 2022

(87) PCT Pub. No.: WO2021/204903
PCT Pub. Date: Oct. 14, 2021

(65) Prior Publication Data

US 2023/0193636 A1 Jun. 22, 2023

(30) Foreign Application Priority Data

Apr. 8, 2020 (EP) ..... 20168713

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 2201/0146* (2013.01); *E04F 2201/042* (2013.01); *E04F 2201/043* (2013.01)

(58) Field of Classification Search
CPC ..... E04F 15/02038; E04F 15/105; E04F 2201/0146; E04F 2201/042; E04F 2201/043
See application file for complete search history.

(56) References Cited

U.S. PATENT DOCUMENTS 10,000,935 B2 * 6/2018 Kell ..... E04F 15/02033
11,987,990 B2 * 5/2024 Pervan ..... E04F 13/0894
(Continued)

FOREIGN PATENT DOCUMENTS

CN 103547749 A 1/2014
DE 202019101807 U1 5/2019
(Continued)

OTHER PUBLICATIONS

International Search Report and Written Opinion of the International Searching Authority issued in PCT/EP2021/059108, mailed Jun. 30, 2021; ISA/EP.
(Continued)

*Primary Examiner* — Paola Agudelo
*Assistant Examiner* — Adam G Barlow
(74) *Attorney, Agent, or Firm* — Harness, Dickey & Pierce, P.L.C.

(57) ABSTRACT

The present disclosure relates to a panel for a paneling, more particularly to a floor panel for a floor covering, comprising: a panel upper surface and a panel lower surface parallel to the panel upper surface, which are mutually spaced by a total thickness; an upper coupling element and a lower coupling element, wherein two panels of this type are designed such that said panels can be coupled to each other by means of a downward movement of the upper coupling element of the first panel relative to the lower coupling element of the second panel; wherein the upper coupling element has a detent element and the lower coupling element has a detent
(Continued)

Figure 1:
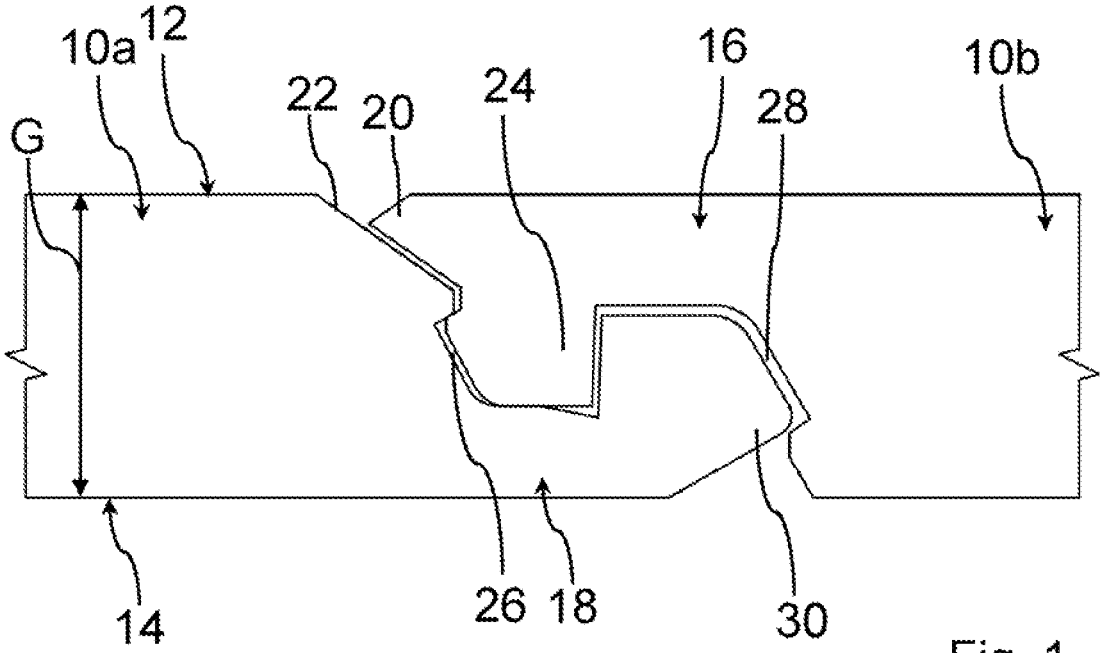

receptacle; wherein the upper coupling element has a locking receptacle and the lower coupling element has a locking element; and wherein a material thickness (UM) of the lower coupling element between the panel lower surface and the detent receptacle is less than 100 percent of a material thickness (OM) of the upper coupling element between the panel upper surface and the locking receptacle.

19 Claims, 1 Drawing Sheet

(56) References Cited

U.S. PATENT DOCUMENTS

2003/0145549 A1* 8/2003 Palsson ..... B44C 3/123 52/589.1
2015/0300029 A1* 10/2015 Pervan ..... E04F 15/02038 52/582.2
2015/0368910 A1* 12/2015 Kell ..... E04F 15/04 52/741.1
2016/0201336 A1* 7/2016 Pervan ..... B26D 3/065 52/582.2
2017/0370109 A1* 12/2017 Devos ..... E04F 15/02038
2020/0263714 A1* 8/2020 Schulte ..... B29C 66/3452
2021/0062517 A1* 3/2021 Markovski ..... E04F 15/02038
2021/0087833 A1* 3/2021 Ylikangas ..... E04F 15/02038
2022/0025657 A1* 1/2022 Pervan ..... E04F 15/102

FOREIGN PATENT DOCUMENTS

EP 3543427 A1 9/2019
EP 3581732 A1 12/2019

OTHER PUBLICATIONS

Chinese Office Action regarding Patent Application No. 202180024745X, dated Jun. 7, 2023.

* cited by examiner

PANEL HAVING FRACTURE-RESISTANT COUPLING ELEMENTS

CROSS-REFERENCE TO RELATED APPLICATIONS

This application is a National Phase of International Application No. PCT/EP2021/059108, filed on Apr. 7, 2021, which claims the benefit of European Patent Application No. 20168713.4, filed on Apr. 8, 2020. The entire disclosures of the above applications are incorporated herein by reference.

FIELD

The present disclosure relates to a panel for a paneling, in particular a floor panel for a floor covering.

BACKGROUND

This section provides background information related to the present disclosure which is not necessarily prior art.

So far known is a panel for a paneling, in particular a floor panel for a floor covering, comprising a panel upper surface and a panel lower surface extending parallel thereto, which are mutually spaced apart from each other by a total thickness, an upper coupling element and a lower coupling element, wherein two panels of this type are designed such that they can be coupled to each other by means of a downward movement of the upper coupling element of the first panel with respect to the lower coupling element of the second panel, wherein

- the upper coupling element has at its distal end a wedge-shaped protrusion and the lower coupling element has a mating surface which, in the coupled state of two panels form a first locking system,
- the upper coupling element has a latching element adjoining the wedge-shaped protrusion and the lower coupling element has a detent receptacle adjoining the mating surface, which in the coupled state of two panels form a second locking system,
- the upper coupling element has a locking receptacle adjoining the latching element and the lower coupling element has at its distal end a locking element adjoining the latching receptacle, which in the coupled state of two panels form a third locking system.

Such a panel thus always comprises a lower coupling element and an upper coupling element. When panels are assembled, an upper coupling element of a panel to be assembled is pressed onto a lower coupling element of a panel that has already been assembled and is lying on the subsurface. In order to form the first locking system, a wedge-shaped protrusion of the upper coupling element is pressed onto a mating surface of the lower coupling element extending oblique to the subsurface. In order to form the second locking system, the lower coupling element is spread open in the area of the detent receptacle by the penetrating latching element of the upper coupling element. In order to form the third locking system, the upper coupling element is spread open in the area of the locking receptacle by the penetrating locking element of the lower coupling element. The spreading of the upper and lower coupling elements leads to high material stresses during assembly and thus frequently to material failure, particularly in the case of panels comprising thermoplastic styrene block co-polymer.

A previously known panel is disclosed, for example, in US laid-open document 2015/0368910 A1. This document discloses an interconnection system for a panel having a first and a second major surface as a panel upper surface and a panel lower surface which are opposite to each other, wherein the interconnection system comprises a male and a female connection that are asymmetric connections extending along opposite sides of the panel, wherein the male and the female connection are configured such as to allow two substrates having identical interconnection systems to engage each another in response to a force applied in an engagement direction which extends perpendicular to the major surfaces, wherein the male and the female connection are each provided with two laterally spaced, transversely extending surfaces configured to allow the male connection of a first panel to engage the female connection of a second panel, wherein the first and the second transversely extending surface of the female connection are arranged relative to the first and the second transversely extending surface of the male connection in order to provide respective first and second locking planes on an innermost and an outermost side of each connection.

SUMMARY

This section provides a general summary of the disclosure, and is not a comprehensive disclosure of its full scope or all of its features.

Based on the foregoing, it is an object of the present disclosure to provide a panel for a paneling, in particular a floor panel for a floor covering, which is improved with respect to the foregoing disadvantages.

The object of the disclosure is achieved by the features of the independent main claim. Advantageous embodiments are provided in the subclaims. If technically possible, the teachings of the subclaims can be combined as desired with the teachings of the main claim and subclaims.

According to the disclosure, the object is thus achieved by a panel for a paneling, in particular a floor panel for a floor covering, comprising a panel upper surface and a panel lower surface extending parallel thereto, which are mutually spaced by a total thickness, an upper coupling element and a lower coupling element, wherein two panels of this type are designed such that they can be coupled to each other by means of a downward movement of the upper coupling element of the first panel with respect to the lower coupling element of the second panel, wherein the upper coupling element has at its distal end a wedge-shaped protrusion and the lower coupling element has a mating surface which in the coupled state of two panels form a first locking system, wherein the upper coupling element comprises a latching element adjoining the wedge-shaped protrusion and the lower coupling element comprises a detent receptacle adjoining the mating surface, which in the coupled state of two panels form a second locking system, wherein the upper coupling element comprises a locking receptacle adjoining the latching element and the lower coupling element comprises at its distal end a locking element adjoining the detent receptacle, which in the coupled state of two panels form a third locking system.

Here, in particular, it is provided that a material thickness of the lower coupling element between the panel lower surface and the detent receptacle is less than 100 percent of a material thickness of the upper coupling element between the panel upper surface and the locking receptacle.

Aspects of the claimed subject matter of the disclosure are explained below, and preferred modified embodiments of the disclosure are described further below. Explanations, particularly with respect to advantages and definitions of features are basically descriptive and preferred but not limiting examples. Where an explanation is limiting, this is explicitly mentioned.

Thus, one idea of the present disclosure is that coupling elements, when two panels are joined together, are spread open with less stress by means of an adapted dimensioning compared to previously known panels and thus tend with reduced risk to material failure or breakage. It has been found that the assembly loads of the lower coupling element can generally be better compensated than the assembly loads of the upper coupling element. Among other things, this is due to the fact that the lower coupling element rests on a subsurface during assembly of the upper coupling element. The forces acting on the lower coupling element can thus be directly and uniformly be counterbalanced by the subsurface and have less damaging effect on individual components of the lower coupling element. In contrast, forces acting on the upper coupling element during the joining of two panels do not have such a possibility for force distribution, so that the upper coupling element is generally more prone to material failure. Such material failure or breakage usually occurs in areas with high stress and the lowest possible material thickness. The lower coupling element has the lowest material thickness between the panel lower surface and the detent receptacle. The upper coupling element has the lowest material thickness between the panel upper surface and the locking receptacle. In the following, the term "material thickness" refers to a minimum or maximum material thickness in this respective area. If the term material thickness is used, this refers to this definition or arrangement.

The disclosure suggests as an improvement of a panel that the material thickness of the upper coupling element is thus greater than the material thickness of the lower coupling element.

In principle, the information on the dimensioning of the panel is given with reference to a longitudinal section of the panel along its main extension axis.

Furthermore, for all of the following dimensionings, it must be taken into account that each feature leads to a reduced risk of material failure of the lower and/or upper coupling element. Here, it is essential that the material thickness of the upper coupling element is greater than the material thickness of the lower coupling element. The further dimensions of the subclaims are in each case advantageous, but not limiting and not absolutely necessary.

According to a modified embodiment of the disclosure, it is provided that the material thickness of the lower coupling element between the panel lower surface and the detent receptacle is greater than or equal to 62 percent preferably greater than or equal to 67 percent, and particularly preferably greater than or equal to 72 percent of the material thickness of the upper coupling element between the panel upper surface and the locking receptacle. It has been found that such a dimensioned lower coupling element particularly advantageously reduces the tendency of its material failure, wherein this is improved with each step since material is increasingly present in the lower coupling element for a component-protecting flux of force distribution.

According to a modified embodiment of the disclosure, it is provided that the material thickness of the lower coupling element between the panel lower surface and the detent receptacle is less than or equal to 82 percent, less than or equal to 77 percent, and particularly preferably less than or equal to 72 percent of the material thickness of the upper coupling element between the panel upper surface and the locking receptacle. Hereby, a preferred maximum stiffness of the lower coupling element is set, so that it is advantageously flexible or resilient for the connection of two panels and no components break out of the upper coupling element.

According to a modified embodiment of the disclosure, it is provided that the material thickness of the upper coupling element between the panel upper surface and the locking receptacle is greater than or equal to 34 percent, preferably greater than or equal to 39 percent, particularly preferably greater than or equal to 44 percent of the total thickness of the panel. It has been found that by use of such a dimensioned upper coupling element its tendency to material failure is particularly advantageously reduced, wherein this is improved with each stage, since in the upper coupling element material is increasingly present for a component-protecting flux of force distribution.

According to a modified embodiment of the disclosure, it is provided that the material thickness of the upper coupling element between the panel upper surface and the locking receptacle is less than or equal to 54 percent, preferably less than or equal to 49 percent, particularly preferably less than or equal to 44 percent of the total thickness of the panel. Hereby, a preferred maximum stiffness of the upper coupling element is set, so that it is advantageously flexible or resilient for the connection of two panels and no components break out of the lower coupling element.

According to a modified embodiment of the disclosure, it is provided that the material thickness of the lower coupling element between the panel lower surface and the detent receptacle is greater than or equal to 24 percent, preferably greater than or equal to 29 percent, particularly preferably greater than or equal to 34 percent of the total thickness of the panel. These values have been found to be a preferred material thickness to further reduce the risk of undesirable material failure of the lower coupling element. This is enabled by an advantageous minimum flux of force distribution volume.

According to a modified embodiment of the disclosure, it is provided that the material thickness of the lower coupling element between the panel lower surface and the detent receptacle is less than or equal to 44 percent, preferably less than or equal to 39 percent, particularly preferably less than or equal to 34 percent of the total thickness of the panel. It has been found that such a material thickness of the lower coupling element within these ranges advantageously sets the stiffness of the lower coupling element in such a manner that both the lower and the upper coupling element are better able to withstand material failure.

According to a modified embodiment of the disclosure, it is provided that a locking element surface of the locking element facing the locking receptacle substantially has a uniform arc shape and/or that a locking receptacle surface of the locking receptacle facing the locking element has a substantially uniform arc shape, wherein the locking element surface and the locking receptacle surface are formed in particular identical in contour. In this regard, in the case of a plurality of arc shapes, a main extension arc is considered to be the prevailing arc shape, regardless of this exemplary embodiment. A main extension arc is those out of several arcs, whose parabolic shape portion at the locking receptacle or at the locking element is the largest. In other words, the main extension arc occupies the longest distance of the locking receptacle or the locking element. In particular, the amount of static friction, which could lead to material failure, is reduced. Substantially uniform arc shapes are those that provide a uniform contact face and thus a uniform distribution of force, and do not include acute angles. This reduces the risk of material failure at the panel.

According to a modified embodiment of the disclosure, it is provided that a radius of the arc shape of the locking element surface and/or a radius of the arcuate shape of the locking receptacle surface is between 85 percent, inclusive, to 95 percent, inclusive, of the total thickness of the panel, and preferably about 90 percent of the total thickness of the panel. It has been found that within these values, a most advantageous and uniform distribution of forces occurs. Due to the respectively resulting flat arc shape the coupling elements are advantageously protected from static friction and thus from a risk of breakage.

According to a modified embodiment of the disclosure, it is provided that a tangent to the center of the arc shape of the locking element surface and/or a tangent to the center of the arc shape of the locking receptacle surface with respect to the panel upper surface and the panel lower surface includes or include a respective arc angle. Preferably, the respective arc angle is less than or equal to 45 degrees, more preferably less than or equal to 35 degrees, particularly preferably less than or equal to 25 degrees. Thus, as many vertical forces as possible can be absorbed horizontally evenly distributed by the locking element of the lower coupling element. At the same time, there is a sufficient inclination to form the third locking system. This has a component-protecting and panel-securing effect.

Accordingly, by way of example, it is preferred that a tangent to the center of the arc shape of the locking element surface with respect to the panel upper surface and the panel lower surface includes a respective arc angle which is preferably less than or equal to 45 degrees, more preferably less than or equal to 35 degrees, particularly preferably less than or equal to 25 degrees.

Preferably, it may be provided that a tangent to the center of the arc shape of the locking receptacle surface with respect to the panel upper surface and the panel lower surface includes a respective arc angle which is preferably less than or equal to 45 degrees, more preferably smaller than or equal to 35 degrees, particularly preferably smaller than or equal to 25 degrees.

Particularly preferably, it may be provided that the tangent to the center of the arc shape of the locking element surface and the tangent to the center of the arc shape of the locking receptacle surface with respect to the panel upper surface and the panel lower surface include a respective arc angle, wherein the respective arc angle is preferably less than or equal to 45 degrees, more preferably less than or equal to 35 degrees, particularly preferably less than or equal to 25 degrees.

That a tangent to the center of the arc shape of the locking element surface with respect to the panel upper surface and the panel lower surface includes a respective arc angle can be understood in particular such that this tangent does not extend vertically or horizontally. In other words, there is an oblique course of the tangent to the subsurface. The arc angle is thus not 0, 90, 180, 270 or 360 degrees with respect to the panel upper surface or with respect to the panel lower surface.

That a tangent to the center of the arc shape of the locking receptacle surface with respect to the panel upper surface and the panel lower surface includes a respective arc angle can be understood in particular in such a way that this tangent does not extend vertically or horizontally. In other words, there is an oblique course of the tangent to the subsurface. Thus, the arc angle is not 0, 90, 180, 270 or 360 degrees with respect to the panel upper surface or with respect to the panel lower surface.

According to a modified embodiment of the disclosure, it is provided that the mating surface includes a respective mating surface angle with respect to the panel upper surface and the panel lower surface. The respective mating surface angle is preferably less than or equal to 45 degrees, preferably less than or equal to 35 degrees, particularly preferably less than or equal to 25 degrees. Thus, as many vertical forces as possible can be absorbed horizontally evenly distributed by the mating surface of the lower coupling element. At the same time, there is a sufficient inclination to form the first locking system. This has a component-protecting and panel-securing effect.

According to a modified embodiment of the disclosure, it is provided that the arc angle and the mating surface angle deviate from each other by less than or equal to 20 degrees, preferably less than or equal to 15 degrees, particularly preferably less than or equal to 10 degrees. It has been found that it is advantageous to make the arc angle and the mating surface angle as similar as possible, so that a uniform distribution of forces can be achieved. In particular, during assembly forces are absorbed evenly so that no successive load maxima occur. Particularly preferably, the arc angle and the mating surface angle correspond to each other.

By way of example, a panel can be provided for a paneling, in particular a floor panel for a floor covering, comprising a panel upper surface and a panel lower surface extending parallel thereto, which are mutually spaced from one another by a total thickness, an upper coupling element and a lower coupling element, wherein two panels of this type are designed such that they can be coupled to each other by means of a downward movement of the upper coupling element of the first panel with respect to the lower coupling element of the second panel, wherein the upper coupling element comprises at its distal end a wedge-shaped protrusion and the lower coupling element comprises a mating surface which, in the coupled state of two panels, form a first locking system, wherein the upper coupling element comprises a latching element adjoining the wedge-shaped protrusion and the lower coupling element comprises a detent receptacle adjoining the mating surface which, in the coupled state of two panels form a second locking system, wherein the upper coupling element comprises a locking receptacle adjoining the latching element and the lower coupling element comprises at its distal end a locking element adjoining the detent receptacle, which in the coupled state of two panels form a third locking system.

Here, in particular, it is provided that a material thickness of the lower coupling element between the panel lower surface and the detent receptacle is less than 100 percent of a material thickness of the upper coupling element between the panel upper surface and the locking receptacle, wherein a tangent to the center of the arc shape of the locking element surface with respect to the panel upper surface and the panel lower surface includes a respective arc angle, wherein the mating surface includes a respective mating surface angle with respect to the panel upper surface and the panel lower surface, wherein the arc angle and the mating surface angle deviate from each other by less than or equal to 20 degrees, preferably less than or equal to 15 degrees, more preferably less than or equal to 10 degrees. Preferably, the respective arc angle is less than or equal to 45 degrees, preferably less than or equal to 35 degrees, particularly preferably less than or equal to 25 degrees. Alternatively preferred or additionally preferred, the respective mating surface angle is less than or equal to 45 degrees, preferably less than or equal to 35 degrees, particularly preferably less than or equal to 25 degrees.

Alternatively, a panel for a paneling, in particular a floor panel for a floor covering, can be provided, comprising a panel upper surface and a panel lower surface extending parallel thereto, which are spaced mutually apart from one another by a total thickness, an upper coupling element and a lower coupling element, wherein two panels of this type are designed such that they can be coupled to each other by means of a downward movement of the upper coupling element of the first panel with respect to the lower coupling element of the second panel, wherein the upper coupling element comprises at its distal end a wedge-shaped protrusion and the lower coupling element comprises a mating surface which, in the coupled state of two panels, form a first locking system, wherein the upper coupling element has a detent element adjoining the wedge-shaped protrusion and the lower coupling element has a detent receptacle adjoining the mating surface, which, in the coupled state of two panels, form a second locking system, and wherein the upper coupling element has a locking receptacle adjoining the detent element and the lower coupling element has at its distal end a locking element adjoining the detent receptacle, which, in the coupled state of two panels, form a third locking system.

Here, in particular, it is provided that a material thickness of the lower coupling element between the panel lower surface and the detent receptacle is less than 100 percent of a material thickness of the upper coupling element between the panel upper surface and the locking receptacle, wherein a tangent to the center of the arc shape of the locking receptacle surface with respect to the panel upper surface and the panel lower surface includes a respective arc angle, wherein the mating surface includes a respective mating surface angle with respect to said panel upper surface and said panel lower surface, wherein said arc angle and said mating surface angle deviate by less than or equal to 20 degrees, preferably less than or equal to 15 degrees, more preferably less than or equal to 10 degrees from each other. Preferably the respective arc angle is less than or equal to 45 degrees, more preferably less than or equal to 35 degrees, and particularly preferably less than or equal to 25 degrees. Alternatively preferably or additionally preferably the respective mating surface angle is less than or equal to 45 degrees, more preferably less than or equal to 35 degrees, particularly preferably less than or equal to 25 degrees.

Further alternatively, a panel for a paneling can be provided, in particular a floor panel for a floor covering, comprising a panel upper surface and a panel lower surface extending parallel thereto, which are spaced mutually from one another by a total thickness, an upper coupling element and a lower coupling element, wherein two panels of this kind are designed such that they can be coupled to each other by means of a downward movement of the upper coupling element of the first panel with respect to the lower coupling element of the second panel, wherein the upper coupling element has at its distal end a wedge-shaped protrusion and the lower coupling element has a mating surface which, in the coupled state of two panels, form a first locking system, the upper coupling element has a latching element adjoining the wedge-shaped protrusion and the lower coupling element has a detent receptacle adjoining the mating surface, which, in the coupled state of two panels, form a second locking system, and wherein the upper coupling element has a locking receptacle adjoining the detent receptacle and the lower coupling element has at its distal end a locking element adjoining the detent receptacle, which, in the coupled state of two panels, form a third locking system.

Here, in particular, it is provided that a material thickness of the lower coupling element between the panel lower surface and the detent receptacle is less than 100 percent of a material thickness of the upper coupling element between the panel upper surface and the locking receptacle; wherein a tangent to the center of the arc shape of the locking element surface and a tangent to the center of the arc shape of the locking receptacle surface with respect to the panel upper surface and the panel lower surface include a respective arc angle; wherein the mating surface with respect to the panel upper surface and the panel lower surface includes a respective mating surface angle, wherein the arc angle and the mating surface angle deviate from each other by less than or equal to 20 degrees, preferably less than or equal to 15 degrees, particularly preferably less than or equal to 10 degrees. Preferably, the respective arc angle is less than or equal to 45 degrees, more preferably less than or equal to 35 degrees, particularly preferably less than or equal to 25 degrees. Alternatively preferred or additionally preferred, the respective mating surface angle is less than or equal to 45 degrees, more preferably less than or equal to 35 degrees, particularly preferably less than or equal to 25 degrees.

According to a modified embodiment of the disclosure, it is provided that the panel has a vertical surface, wherein the mating surface extends between the panel upper surface and the vertical surface. Optionally, it is possible that in a longitudinal sectional view of the panel, a distance of the vertical surface is shorter than a distance of the mating surface. Optionally, it is possible that the distance of the mating surface is at least three times, preferably at least five times, the distance of the vertical surface. Alternatively or additionally optionally, it is possible that the distance of the mating surface is at most eleven times, preferably at most nine times, the distance of the vertical surface. Exemplarily, the distance of the mating surface corresponds essentially seven times the distance of the vertical surface. Essentially seven times means here that values less than eight times and greater than six times are preferably included. However, it is also possible that exactly the value seven times applies. The vertical area of the panel is an area of the panel that extends vertically to the subsurface or also vertically to the panel upper surface. Accordingly, the panel may include the vertical area regardless of the other combinations of features of this paragraph. It has been found that the significantly longer design of the mating surface compared to the vertical surface enables a component-protecting force distribution, since the mating surface, by virtue of having more contact surface, allows a more widely distributed load absorption by the panel to be assembled and the vertical surface offers less interaction or load surface for the panel to be assembled in an interacting manner due to its shorter distance during panel assembly. The aforementioned multiple values thus include the original distance and are not to be added thereto.

According to a modified embodiment of the disclosure, it is provided that the locking element has a locking outer surface which leads to the panel lower surface and includes a locking angle with respect to a vertical plane, which is preferably less than or equal to 35 degrees, more preferably less than or equal to 30 degrees, particularly preferably less than or equal to 25 degrees. It has been found that this allows vertically acting forces to be well directed into the subsurface while spreading open the locking element as little as possible.

According to a modified embodiment of the disclosure, it is provided that an extension of the locking receptacle transitioning to the latching element is formed as a rounding. In particular, when the upper coupling element is fitted onto the lower coupling element, the upper coupling element spreads out between the locking receptacle and the latching element. The rounding reduces load peaks and thus reduces the risk of material failure occurring in the transition from the locking receptacle to the latching element.

According to a modified embodiment of the disclosure it is provided that an edge of the locking element facing an extension of the locking receptacle is formed as a rounding. This reduces the risk of tilting between the locking element of the lower coupling element and the latching element of the upper coupling element during assembly of two panels.

According to a modified embodiment of the disclosure, it is provided that the latching element has a latching protrusion and the detent receptacle has a latching counter-bearing which, in the coupled state of two panels, form the second locking system. Such an embodiment enables a reliable, form-fitting second locking system, wherein the interaction of the latching protrusion and the latching counter-bearing enables that the panel is not subjected to any component-damaging load.

According to a modified embodiment of the disclosure, it is provided that the locking element comprises a locking protrusion and the locking receptacle comprises a locking counter-bearing, which, in the coupled state of two panels, form the third locking system. Such an embodiment allows for a reliable, form-fitting third locking system, wherein the interaction of locking protrusion and locking counter-bearing enables that the panel is not subjected to any component-damaging load.

According to a modified embodiment of the disclosure, it is provided that the panel comprises at least partially, preferably entirely, thermoplastic styrenic block copolymers, TPS, as a base material. It has been found that TPS-containing panels are particularly suitable for the claimed dimensioning of the coupling elements. Equivalent materials in this context are those that have similar properties to TPS or that only partially contain TPS.

DRAWINGS

The drawings described herein are for illustrative purposes only of selected embodiments and not all possible implementations, and are not intended to limit the scope of the present disclosure.

In the following, the disclosure is explained in more detail with reference to the accompanying drawings based on preferred exemplary embodiments. The term figure is abbreviated in the drawings as FIG.

Figure 2:
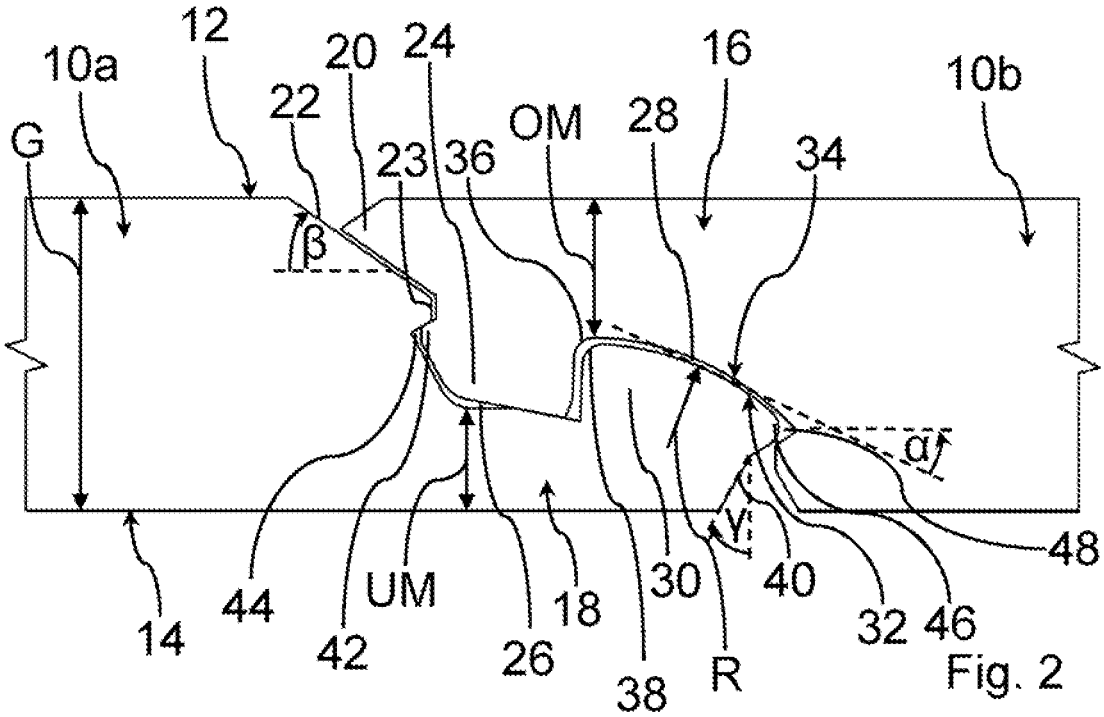

In the drawings:

FIG. 1 shows a schematic longitudinal sectional view of two interconnected panels according to the prior art; and FIG. 2 shows a schematic longitudinal sectional view of two interconnected panels according to a preferred exemplary embodiment of the disclosure.

Corresponding reference numerals indicate corresponding parts throughout the several views of the drawings.

DETAILED DESCRIPTION

Example embodiments will now be described more fully with reference to the accompanying drawings.

The described exemplary embodiments are merely examples, which may be modified and/or supplemented in a variety of ways within the scope of the claims. Any feature described for a particular exemplary embodiment may be used independently or in combination with other features in any other exemplary embodiment. Any feature described for an exemplary embodiment of a particular claim category may also be used in a corresponding manner in an exemplary embodiment of another claim category.

FIG. 1 shows a schematic longitudinal sectional view of two interconnected panels 10*a*, 10*b* according to the prior art. Here, the representation is to be understood purely schematically and does not exhibit any correctness to scale due to the arbitrary representation.

FIG. 2 shows a schematic longitudinal sectional view of two interconnected panels 10*a*, 10*b* according to a preferred exemplary embodiment of the disclosure. Thus, respectively a panel 10*a*, 10*b* is provided for a paneling, in particular a floor panel for a floor covering. Although two different panels 10*a*, 10*b* are shown, each panel 10*a*, 10*b* respectively comprises: a panel upper surface 12 and a panel lower surface 14 extending parallel thereto, which are mutually spaced from each other by a total thickness G, an upper coupling member 16 and a lower coupling member 18, wherein two panels 10*a*, 10*b* of this type are designed such that they can be coupled to each other by means of a downward movement of the upper coupling element 16 of the first panel 10*a* with respect to the lower coupling element 18 of the second panel 10*b*, wherein the upper coupling member 16 has at its distal end a wedge-shaped protrusion 20 and the lower coupling member 18 has a mating surface 22 which, in the coupled state of two panels 10*a*, form a first locking system, wherein the upper coupling element 16 comprises a latching element 24 adjoining the wedge-shaped protrusion 20 and the lower coupling element 18 comprises a detent receptacle 26 adjoining the mating surface 22, which, in the coupled state of two panels 10*a*, 10*b* form a second locking system, wherein the upper coupling element 16 comprises a locking receptacle 28 adjoining the latching element 24 and the lower coupling element 18 comprises at its distal end a locking element 30 adjoining the detent receptacle 26, which, in the coupled state of two panels 10*a*, 10*b*, form a third locking system.

Here, in particular, it is provided that a material thickness UM of the lower coupling element 18 between the panel lower surface 14 and the detent receptacle 26 is less than 100 percent of a material thickness OM of the upper coupling element 16 between the panel upper surface 12 and the locking receptacle 28.

The upper coupling element 16 and the lower coupling element 18 are illustrated by two different panels 10*a*, 10*b* that are connected to each other. However, each panel 10*a*, 10*b* comprises such an upper coupling element 16 and such a lower coupling element 18. This is independent of the exemplary embodiment shown in FIG. 2.

Furthermore, the panels 10*a*, 10*b* are shown in FIG. 2 according to an exemplary preferred scale.

Furthermore, an exemplary embodiment of the disclosure according to FIG. 2 preferably provides that the material thickness UM of the lower coupling element 18 between the panel lower surface 14 and the detent receptacle 26 is greater than or equal to 62 percent, preferably greater than or equal to 67 percent and particularly preferably greater than or equal to 72 percent of the material thickness OM of the upper coupling element 16 between the panel upper surface 12 and the locking receptacle 28. In the exemplary embodiment of the disclosure according to FIG. 2, this value is exemplarily and independently of other features of this exemplary embodiment 72 percent.

Furthermore, an exemplary embodiment of the disclosure according to FIG. 2 preferably provides that the material thickness UM of the lower coupling element 18 between the panel lower surface 14 and the detent receptacle 26 is less than or equal to 82 percent, preferably less than or equal to 77 percent and particularly preferably less than or equal to 72 percent of the material thickness OM of the upper coupling element 16 between the panel upper surface 12 and the locking receptacle 28. In the exemplary embodiment of the disclosure according to FIG. 2, this value is exemplarily and independently of other features of this exemplary embodiment 72 percent.

Furthermore, an exemplary embodiment of the disclosure according to FIG. 2 preferably provides that the material thickness OM of the upper coupling element 16 between the panel upper surface 12 and the locking receptacle 28 is greater than or equal to 34 percent, more preferably greater than or equal to 39 percent, particularly preferably greater than or equal to 44 percent of the total thickness G of the panel 10*a*, 10*b*. In the exemplary embodiment of the disclosure according to FIG. 2, this value is exemplarily and independently of other features of this exemplary embodiment 44 percent.

Furthermore, an exemplary embodiment of the disclosure according to FIG. 2 preferably provides that the material thickness OM of the upper coupling element 16 between the panel upper surface 12 and the locking receptacle 28 is less than or equal to 54 percent, more preferably less than or equal to 49 percent, particularly preferably less than or equal to 44 percent of the total thickness G of the panel 10*a*, 10*b*. In the exemplary embodiment of the disclosure according to FIG. 2, this value is exemplarily and independently of other features of this exemplary embodiment 44 percent.

Furthermore, an exemplary embodiment of the disclosure according to FIG. 2 preferably provides that the material thickness UM of the lower coupling element 18 between the panel lower surface 14 and the detent receptacle 26 is greater than or equal to 24 percent, more preferably greater than or equal to 29 percent, particularly preferably greater than or equal to 34 percent of the total thickness G of the panel 10*a*, 10*b*. In the exemplary embodiment of the disclosure according to FIG. 2, this value is by way of example and independently of other features of this exemplary embodiment 34 percent.

Furthermore, an exemplary embodiment of the disclosure according to FIG. 2 preferably provides that the material thickness UM of the lower coupling element 18 between the panel lower surface 14 and the detent receptacle 26 is less than or equal to 44 percent, more preferably less than or equal to 39 percent, particularly preferably less than or equal to 34 percent of the total thickness G of the panel 10*a*, 10*b*. In the exemplary embodiment of the disclosure according to FIG. 2, this value is by way of example and independently of other features of this exemplary embodiment 34 percent.

Furthermore, an exemplary embodiment of the disclosure according to FIG. 2 preferably provides that a locking element surface 32 of the locking element 30 facing the locking receptacle 28 has a substantially uniform arc shape and/or that a locking receptacle surface 34 of the locking receptacle 28 facing the locking element 30 has a substantially uniform arc shape, wherein the locking element surface 32 and the locking receptacle surface 34 are formed, in particular, substantially identical in contour. In the exemplary embodiment of the disclosure according to FIG. 2, this is shown exemplary and independent of other features of this exemplary embodiment. Thus, both the locking element surface 32 and the locking receptacle surface 34 have such an arc shape. Here, in the case of multiple arc shapes, a main extension arc is considered to be the prevailing arc shape, regardless of this exemplary embodiment. A main extension arc is the one of several arcs whose parabolic shape portion is the largest at the locking receptacle 28 or the locking element 30. In other words, the main extension arc occupies the longest distance of the locking receptacle 28 and the locking element 30, respectively. As can be seen in FIG. 2, the locking receptacle 28 and the locking element 30 are substantially identical in contour, namely a flat curvature. Substantially refers to the fact that contour variations may be present starting from the respective end of the arc shapes of the locking element surface 32 and the locking receptacle surface 34.

Furthermore, an exemplary embodiment of the disclosure according to FIG. 2 preferably provides that a radius R of the arc shape of the locking element surface 32 and/or a radius of the arc shape of the locking receptacle surface 34 is/are in the range between and including 85 percent to and including 95 percent of the total thickness G of the panel 10*a*, 10*b*. In the exemplary embodiment of the disclosure according to FIG. 2 this value is by way of example and independently of other features of this exemplary embodiment about 90 percent of the total thickness G of the panel 10*a*, 10*b*. Here, about means that a deviation from and including 87.5 percent to and including 92.5 percent can be present, wherein exactly 90 percent are preferred.

Furthermore, an exemplary embodiment of the disclosure according to FIG. 2 preferably provides that a tangent to the center of the arc shape of the locking element surface 32 and/or a tangent to the center of the arc shape of the locking receptacle surface 34 with respect to the panel upper surface 12 and the panel lower surface 14 includes or include a respective arc angle alpha, wherein the respective arc angle alpha is preferably less than or equal to 45 degrees, more preferably less than or equal to 35 degrees, more preferably less than or equal to 25 degrees. The tangent to the center of the arc shape of the locking receptacle surface 34 is here determined analogously from the side of the locking element surface 32. In the exemplary embodiment of the disclosure according to FIG. 2, the respective arc angle alpha of the locking element surface 32 and the locking receptacle surface 34 is by way of example and independently of other features of this exemplary embodiment 22 degrees.

Furthermore, an exemplary embodiment of the disclosure according to FIG. 2 preferably provides that the mating surface 22 with respect to the panel upper surface 12 and the panel lower surface 14 includes a respective mating surface angle beta which is preferably less than or equal to 45 degrees, more preferably less than or equal to 35 degrees, particularly preferably less than or equal to 25 degrees. In the exemplary embodiment of the disclosure according to FIG. 2, the respective mating surface angle beta is by way of example and independently of other features of this exemplary embodiment 35 degrees.

Furthermore, an exemplary embodiment of the disclosure according to FIG. 2 preferably provides that the arc angle alpha and the mating surface angle beta deviate by less than or equal to 20 degrees, preferably less than or equal to 15 degrees, particularly preferably less than or equal to 10 degrees from each other. In the exemplary embodiment of the disclosure according to FIG. 2, the arc angle alpha and the mating surface angle beta deviate from each other by way of example and independently of other features of this exemplary embodiment by 13 degrees.

In FIG. 2, it is exemplarily shown that the mating surface 22 extends between the panel upper surface 12 and a vertical surface 23 of the panel 10*a*. Here, in a longitudinal sectional view of the panel 10*a*, the distance of the vertical surface 23 is shown to be shorter than the distance of the mating surface 22. Preferably shown, the distance of the mating surface 22 is substantially seven times the distance of the vertical surface 23.

Furthermore, an exemplary embodiment of the disclosure according to FIG. 2 preferably provides that the locking element 30 comprises a locking outer surface 40 which leads to the panel lower surface 14 and includes a locking angle gamma with respect to a vertical plane, which is preferably less than or equal to 35 degrees, more preferably less than or equal to 30 degrees, particularly preferably less than or equal to 25 degrees. In the exemplary embodiment of the disclosure according to FIG. 2, the locking angle gamma is by way of example and independently of other features of this exemplary embodiment 30 degrees.

Furthermore, an exemplary embodiment of the disclosure according to FIG. 2 preferably provides that an extension 36 of the locking receptacle 28 transitioning to the latching element 24 is formed as a rounding.

Furthermore, an exemplary embodiment of the disclosure according to FIG. 2 preferably provides that an edge 38 of the locking element 30 facing an extension 36 of the locking receptacle 28 is formed as a rounding.

Furthermore, an exemplary embodiment of the disclosure according to FIG. 2 preferably provides that the latching element 24 comprises a latching protrusion 42 and the detent receptacle 26 comprises a latching counter-bearing 44, which, in the coupled state of the two illustrated panels 10*a*, 10*b*, form the second locking system.

Furthermore, an exemplary embodiment of the disclosure according to FIG. 2 preferably provides that the locking member 30 comprises a locking protrusion 46 and the locking receptacle 28 comprises a locking counter-bearing 48 which, in the coupled state of the two illustrated panels 10*a*, 10*b*, form the second locking system.

Furthermore, an exemplary embodiment of the disclosure according to FIG. 2 preferably provides that the panel 10*a*, 10*b* comprises at least partially, preferably completely, thermoplastic styrene block copolymers, TPS, as a base material.

The foregoing description of the embodiments has been provided for purposes of illustration and description. It is not intended to be exhaustive or to limit the disclosure. Individual elements or features of a particular embodiment are gen-erally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A panel for a paneling, in particular floor panel for a floor covering, comprising:

a panel upper surface and a panel lower surface extending parallel thereto, which are mutually spaced from each other by a total thickness (G);

an upper coupling element and a lower coupling element, wherein two panels of this type can be coupled to each other by means of a downward movement of the upper coupling element of the first panel with respect to the lower coupling element of the second panel, wherein the upper coupling element has at its distal end a wedge-shaped protrusion and the lower coupling element has a mating surface, which, in the coupled state of two panels, form a first locking system, the upper coupling element has a latching element adjoining the wedge-shaped protrusion and the lower coupling element has a detent receptacle adjoining the mating surface which, in the coupled state of two panels, form a second locking system, the upper coupling element has a locking receptacle adjoining the latching element, and the lower coupling element has at its distal end a locking element adjoining the detent receptacle, which, in the coupled state of two panels, form a third locking system wherein a material thickness (UM) of the lower coupling element between the panel lower surface and the detent receptacle is less than 100 percent of a material thickness (OM) of the upper coupling element between the panel upper surface and the latching receptacle, a locking element surface of the locking element facing the locking receptacle has essentially a uniform arc shape; a tangent to the center of the arc shape of the locking receptacle surface with respect to the panel upper surface and the panel lower surface includes a respective arc angle (alpha) less than or equal to 45 degrees; the mating surface with respect to the panel upper surface and the panel lower surface includes a respective mating surface angle (beta) of less than or equal to 45 degrees; the arc angle (alpha) and the mating surface angle (beta) deviate by less than or equal to 20 degrees from each other.

2. The panel according to claim 1, wherein the material thickness (UM) of the lower coupling element between the panel lower surface and the detent receptacle is greater than or equal to 62 percent of the material thickness (OM) of the upper coupling element between the panel upper surface and the locking receptacle.

3. The panel according to claim 1, wherein the material thickness (UM) of the lower coupling element between the panel lower surface and the detent receptacle is less than or equal to 82 percent of the material thickness (OM) of the upper coupling element between the panel upper surface and the locking receptacle.

4. The panel according to claim 1, wherein the material thickness (OM) of the upper coupling element between the panel upper surface and the locking receptacle is greater than or equal to 34 percent of the total thickness (G) of the panel.

5. The panel according to claim 1, wherein the material thickness (OM) of the upper coupling element between the panel upper surface and the locking receptacle is less than or equal to 54 percent of the total thickness (G) of the panel.

6. The panel according to claim 1, wherein the material thickness (UM) of the lower coupling element between the panel lower surface and the detent receptacle is greater than or equal to 24 percent of the total thickness (G) of the panel.

7. The panel according to claim 1, wherein the material thickness (UM) of the lower coupling element between the panel lower surface and the detent receptacle is less than or equal to 44 percent of the total thickness (G) of the panel.

8. The panel according to claim 1, wherein the locking element surface and the locking receptacle surface are designed identical in contour to one another.

9. The panel according to claim 8, wherein a radius (R) of the arc shape of the locking element surface and/or a radius of the arc shape of the locking receptacle surface is between 85 percent inclusive to 95 percent inclusive of the total thickness (G) of the panel.

10. The panel according to claim 8, wherein the respective arc angle (alpha) is less than or equal to 35 degrees.

11. The panel according to claim 1, wherein the respective mating surface angle (beta) is less than or equal to 35 degrees.

12. The panel according to claim 11, wherein wherein the arc angle (alpha) and the mating surface angle (beta) deviate by less than or equal to 15 degrees.

13. The panel according to claim 1, wherein the locking element comprises a locking outer surface which leads to the panel lower surface and includes a locking angle (gamma) with respect to a vertical plane, wherein the locking angle (gamma) is less than or equal to 35 degrees.

14. The panel according to claim 1, wherein an extension of the locking receptacle transitioning to the latching element is formed as a rounding.

15. The panel according to claim 1, wherein an edge of the locking element facing to an extension of the locking receptacle is formed as a rounding.

16. The panel according to claim 1, wherein the latching element has a latching protrusion and the detent receptacle has a latching counter-bearing which, in the coupled state of two panels, form the second locking system.

17. The panel according to claim 1, wherein the locking element comprises a locking protrusion and the locking receptacle comprises a locking counter-bearing, which, in the coupled state of two panels, form the third locking system.

18. The panel according to claim 1, wherein the panel comprises thermoplastic styrene block copolymers, TPS, as a base material.

19. A panel for a paneling, in particular floor panel for a floor covering, comprising:

a panel upper surface and a panel lower surface extending parallel thereto, which are mutually spaced from each other by a total thickness (G);

an upper coupling element and a lower coupling element, wherein two panels of this type can be coupled to each other by means of a downward movement of the upper coupling element of the first panel with respect to the lower coupling element of the second panel, wherein the upper coupling element has at its distal end a wedge-shaped protrusion and the lower coupling element has a mating surface, which, in the coupled state of two panels, form a first locking system, the upper coupling element has a latching element adjoining the wedge-shaped protrusion and the lower coupling element has a detent receptacle adjoining the mating surface which, in the coupled state of two panels, form a second locking system, the upper coupling element has a locking receptacle adjoining the latching element, and the lower coupling element has at its distal end a locking element adjoining the detent receptacle, which, in the coupled state of two panels, form a third locking system, wherein a material thickness (UM) of the lower coupling element between the panel lower surface and the detent receptacle is less than 100 percent of a material thickness (OM) of the upper coupling element between the panel upper surface and the latching receptacle, that a locking receiving surface of the locking receptacle facing the locking element has a substantially uniform arc shape;

in that a tangent to the centre of the arcuate shape of the locking receiving surface relative to the panel upper surface and the panel lower surface includes a respective arc angle (alpha) less than or equal to 45 degrees;

said mating surface includes a respective mating surface angle (beta) of less than or equal 45 degrees with respect to said panel surface and said panel lower surface;

in that the arc angle (alpha) and the mating surface angle (beta) differ by less than or equal to 20 degrees.

* * * * *